US006279773B1

(12) United States Patent
Kiyota

(10) Patent No.: US 6,279,773 B1
(45) Date of Patent: Aug. 28, 2001

(54) LID BODY OF BEVERAGE CONTAINER

(75) Inventor: Hozumi Kiyota, Chiba (JP)

(73) Assignee: Kiyota Engineering Co., Ltd., Chiba (JP)

( * ) Notice: Subject to any disclaimer, the term of this patent is extended or adjusted under 35 U.S.C. 154(b) by 0 days.

(21) Appl. No.: 09/576,034

(22) Filed: May 23, 2000

(30) Foreign Application Priority Data

May 26, 1999 (JP) ..... 11-146977

(51) Int. Cl.[7] ..... A47G 19/22
(52) U.S. Cl. ..... 220/709; 220/711
(58) Field of Search ..... 220/707, 708, 220/709, 711, 714, 715, 713; 215/229, 388, 389

(56) References Cited

U.S. PATENT DOCUMENTS 5,203,468 * 4/1993 Hsu ..... 220/254
5,339,982 * 8/1994 Tardie ..... 220/708
5,346,081 * 9/1994 Lin .
5,361,934 * 11/1994 Spence, Jr. ..... 220/707
5,582,320 * 12/1996 Lin ..... 220/708
5,897,013 * 4/1999 Manganiello ..... 220/252

FOREIGN PATENT DOCUMENTS 57-186367 11/1982 (JP) .

OTHER PUBLICATIONS

English Language Abstract of JP 57–186367.

* cited by examiner

*Primary Examiner*—Stephen Castellano
(74) *Attorney, Agent, or Firm*—Greenblum & Bernstein, P.L.C.

(57) ABSTRACT

To provide the lid body of a beverage container, wherein a mouthpiece tube communicated to the beverage container is stored within a storing portion in the blocked condition by one-touch operation of an openable lid and taken out of the storing portion by one-touch operation, and the lid body of a beverage container with a cap, wherein a cap which can store the mouthpiece tube is connectably provided therein.

The lid body of a beverage container is composed of a main body portion and an openable lid mounted on the main body portion. The main body portion comprises a bowl-like storing portion for storing a mouthpiece tube.

On the other hand, the openable lid are projected a pair of connecting portions for connecting each of the switching mechanisms.

16 Claims, 10 Drawing Sheets

(a)

(b)

LID BODY OF BEVERAGE CONTAINER

TECHNICAL FILED

This invention relates to a lid body detachably mounted on the mouth portion of a beverage container, and to a lid body with a cap provided with a cap connectable with the lid body. More particularly, the invention relates to a plastic lid body provided with a mouthpiece tube for easily drinking a beverage without removing the lid body mounted on the mouth portion of a container, and to a lid body with a cap comprising the lid body and a cap connectable with the lid body and storing a suction tube for sucking a beverage within a beverage container connectable with a mouthpiece tube provided in the lid body.

BACKGROUND ART

In recent years, with an affluent standard of national living, each kind of beverages has been sold and natural drinks and each kind of tea and the like are developed with rapid force combined with a healthy food boom. Particularly, natural drinks contained in plastic containers such as plastic (PET) bottles and the like have become essential daily goods around the young age group, and living necessaries among not only household but also working place and pleasure resort. Moreover, in each kind of sports such as tennis, soccer and the like, active supply of water is recommended in the midst of sports, and various sports drinks are offered.

However, as the lid body of a beverage container containing these beverages is a screw type, in case of drinking several times after opening the lid, it is necessary to completely screw the lid on the mouth portion of the beverage container every time when a beverage is drunk, and its handling is troublesome, and it is difficult to completely open or seal the lid body in one hand, so that a beverage cannot simply be drunk from a beverage container in the midst of sports, cycling, driving and the like or by patients having handicapped hands.

Moreover, as the mouth portion of a beverage container is wide, it is difficult to suck, and as a result, a mouth is directly applied to the mouth portion of a container and the container is tilted for guzzling, or a beverage is poured into a receiver such as cup, bowl and the like for drinking. However, direct drinking is insanitary, and inconvenient such as choking or spluttering with excessive beverage.

Furthermore, a drinking style of pouring into a receiver always requires the receiver, and in case of pouring into the receiver, there are such problems that if a beverage container is hastily tilted, a beverage is forcibly discharged to overflow from the receiver and the like.

In order to dissolve such inconvenience, as shown in FIG. 10, there is known such a type that on a screw portion of a mouth portion of a beverage container 100 after opening is screwed a lid body 104 bored a hole 102 for mounting a straw 101 and a through-hole 103 for inserting the other end side of the straw 101 nakedly projected out of a main body of the beverage container, one end side of the flexible straw 101 is inserted from the hole 102 for mounting the straw into the beverage container, the other end side of the straw is projected out of the container as a suction portion in use, while the other end side of the nakedly projected straw is inserted into the through-hole 103 in non-use. (Japanese Utility Model Publication No. 57-186367)

According to the above type, it becomes possible to suck a necessary amount of a beverage from a suction portion of the straw 101 without tilting the beverage container 100, and, in case of non-use, the other end side of the straw corresponding to the suction portion is inserted into the through-hole 103, thereby preventing the suction portion from adhering to dirt, dust and the like.

However, according to such prior art, it is necessary to use both hands for removing the straw 101 from the through-hole 103 of the lid body 104, or inserting the straw into the through-hole 103, particularly, as a diameter of the through-hole 103 is small, it is difficult to align the through-hole with the straw 101, and it is inconvenient to use it in the midst of body movement such as walking, exercising and the like.

Moreover, at the time of non-use, the straw 101 is largely projected in reverse U-shape onto the surface of the lid body 104 between the hole 102 and the through-hole 103, and as there is no means for fixing and holding the straw 101 in the through-hole 103, when the projected portion of the straw 101 hits on some object during carrying, or the container is vigorously swung vertically or unexpectedly falls, there was a possibility of slipping the other end side of the straw 101 out of the through-hole 103 and leaking the beverage to the outside.

Furthermore, the straw 101 inserted into the beverage container is one flexible long tube, and there is no means for supporting and fixing the straw in the hole 102 of the lid body 104. Therefore, when the suction portion of the straw is unconsciously bitten or pulled at the time of sucking and drinking, length or direction of the suction portion projected from the container is changed, and it is inconvenient for confirming the position of the suction portion every time when drinking.

Moreover, since the straw 101 was carried under the condition of inserting into the hole 102 of the lid body 104 or removing therefrom until it was mounted onto the beverage container, the straw 101 was easily lost, and the nakedly protruded straw 101 was insanitary.

Then, the invention relates to a lid body of a beverage container detachably mounted on a mouth portion of the beverage container, more particularly, relates to a lid body of a beverage container with a mouthpiece tube which can be handled by one hand even in the midst of moving the body such as sports, cycling, drive and the like, or even by a patient who is hard to freely use his hands.

An object of the invention is, in view of the problems of such prior art, to provide a sanitary lid body of a beverage container having a storing portion for storing a mouthpiece tube for sucking and drinking a beverage and an openable lid for opening and closing the storing portion.

Further, another object of the invention is to provide a lid body of a beverage container which is easily handled such that the mouthpiece tube is stored within the main body portion with lid-closing operation of the openable lid by one touch, and is released and standing from the storing portion with lid-opening operation of the openable lid by one touch.

Further, a further object of the invention is to provide a lid body of a beverage container without leaking a beverage by storing the mouthpiece tube within the main body of the lid body in the folded state even when the beverage container falls or is vigorously swung vertically.

Moreover, a more further object of the invention is to provide a lid body of a beverage container which can easily be handled by anybody who is troubled with eyesight and the blind.

Further, another object of the invention is to provide a lid body of a beverage container which lid body is conveniently carried.

Further, a further object of the invention is to provide a lid body with a cap, wherein the cap for storing a suction tube connectable with a mouthpiece tube provided in the lid body of the beverage container for sucking a beverage is connectably provided in the lid body.

DISCLOSURE OF THE INVENTION

In order to attain such objects, the invention notices elasticity and flexibility of a mouthpiece tube, and constructs a standing mouthpiece tube to be compactly folded and stored in the blocked state against its elasticity at the time of non-use, and the mouthpiece tube to be stood with its elasticity by releasing the stored state at the time of use.

Moreover, at the time of non-use, it is constructed to block a through-hole provided in a baseplate of the storing portion for storing the mouthpiece tube with a tube wall of the folded mouthpiece tube.

Moreover, the mouthpiece tube provided in the lid body comprises a cap for sorting a connectable suction tube, for example, until the lid body is mounted on a beverage container, there is constructed the suction tube to be stored in the cap and the cap is fitted to the outer periphery of the thread portion of the lid body.

In concrete terms, the lid body for mounting the mouth portion of the beverage container is composed of a main body portion and an openable lid openably mounted on the main body portion, and the main body portion is composed of a storing portion for storing a mouthpiece tube and a thread portion for threading to the mouth portion of the beverage container.

The storing portion and the thread portion are arranged with a common baseplate in opposite directions, and through the baseplate is passed a coupling tube passing through the storing portion and the thread portion. The coupling tube projected into the storing portion is detachably connected to the base end side of the mouthpiece tube projected from the storing portion, and the coupling tube projected into the thread portion is detachably connected to the end side of the suction tube inserted into the bottom within the beverage container, respectively. Therefore, when a mouthpiece portion is held in mouth for sucking, a beverage within the beverage container rises within the suction tube and is sucked via the coupling tube and the mouthpiece tube.

The storing portion is bowl-like shaped provided with a peripheral wall portion expanded from the baseplate to the outside. A portion opposed to a radial direction of the peripheral wall portion is provided with a pair of switching devices for controlling opening and closing an openable lid.

Each switching device has a socket integrally molded with the peripheral wall portion and a lock release button movable within the socket against spring force. At the back of the openable lid is provided a pair of connecting portions connectable with each lock release button, and when the openable lid is closed, each connecting portion is connected with the respectively corresponding lock release button of the switching device to maintain the blocked condition of the openable lid, and when a pair of lock release buttons is depressed against spring force, the connected condition is released and the openable lid opens.

At an upper edge of the peripheral wall portion directly intersecting at a straight line connecting a pair of switching devices each other is secured an openable lid provided with a hinge portion. From the back of the openable lid, with lid-closing action of the openable lid, is pushed a mouthpiece tube under the blocked state within the storing portion, thereby projecting a presser piece standing by elasticity of the mouthpiece tube with lid-opening action of the openable lid.

The cap is an almost cylindrical member opened at one end surface connectably provided in the lid body. The cap is provided with a container portion, and within the container portion is stored a suction tube connectable with a coupling tube projected within the thread portion at the base end portion and inserted into the beverage container at the other end. There is formed a cylindrical standing wall stood upward through a step portion from the container portion, and the inner surface of the standing wall is fixed into the outer peripheral surface of the thread portion.

DESCRIPTION OF THE PREFERRED EMBODIMENTS

Figure 1:
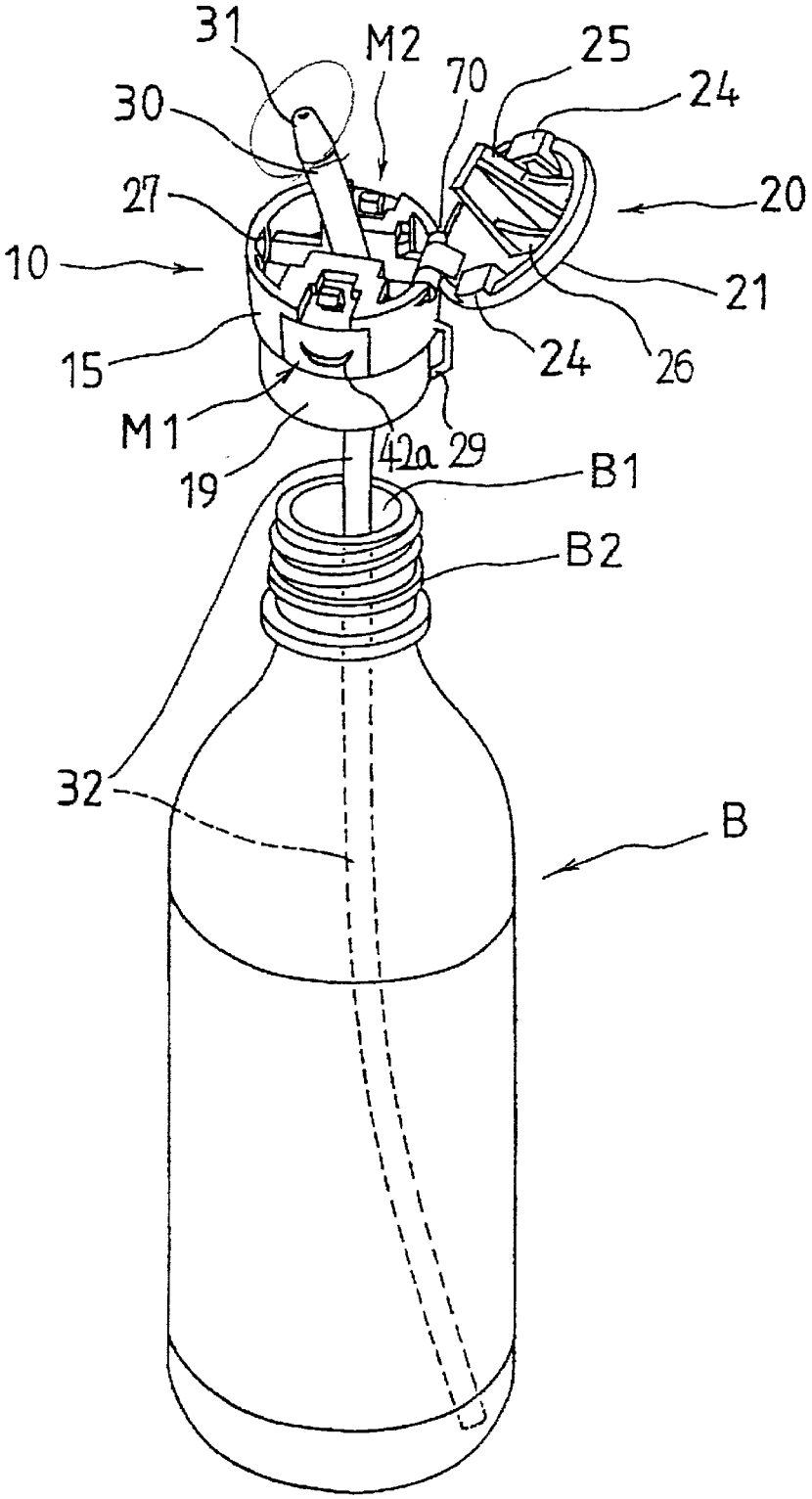
FIG. 1 is a perspective view showing the lid body of the beverage container of the invention.

FIG. 1 shows a perspective view of the lid body of the invention removed from a beverage container. Moreover, a cap 90 for storing a suction tube 32 is omitted. The lid body of the invention is composed of a main body portion 10 threaded in a mouth portion B1 of a beverage container B and an openable lid 20 openably mounted on the main body portion 10 via a hinge portion 70.

The container B, for example, is a plastic bottle having the mouth portion B1 at the upper part, and at the outer periphery of the mouth portion B1 is formed a male screw portion B2. The main body portion 10 and the openable lid 20 are molded with synthetic resin material having appropriate elasticity such as polypropylene, ABS resin and the like.

Figure 6:
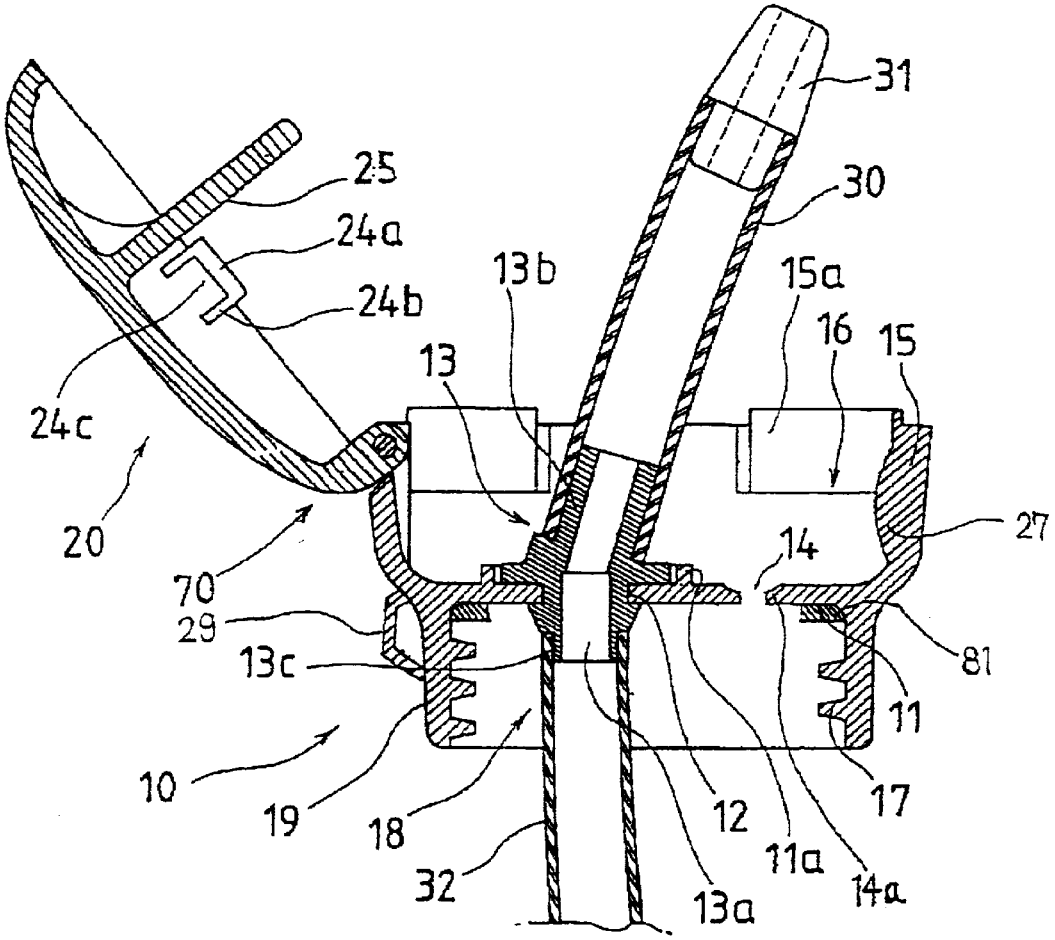
FIG. 6 is an expanded sectional view diagram showing the opened openable lid of the lid body of the beverage container of the invention.

The main body portion 10 is divided into a storing portion 16 positioned upward from a baseplate 11 and a thread portion 18 positioned downward by a baseplate 11, and the storing portion 16 is shaped bowl-like having a peripheral wall portion 15 expandably rising from the periphery of the baseplate 11 to the upper part. The inner wall of the peripheral wall portion 15 is provided with a plurality of standing edges 15*a* slightly projected from the peripheral wall portion 15 (FIG. 6).

On the other hand, a thread portion 18 is shaped cylindrical having a skirt portion 19 suspending downward from the periphery of the baseplate 11, and the inner wall of the skirt portion 19 is provided with a female screw portion 17 threaded with the male screw portion B1 of the container B. Further, into a corner periphery of the baseplate on the side of the thread portion 18 is detachably inserted an annular packing 81 for sealing the upper edge of the mouth portion B1 of the beverage container.

Moreover, the baseplate 11, the peripheral wall portion 15, the female screw portion 17 and the skirt portion 19 for composing the main body portion are integrally formed with the above-described synthetic resin material.

In the baseplate 11 are provided a communicating hole 12 and an air hole 14 for communicating the storing portion 16 and the thread portion 18. The air hole 14 opened to the side of the storing portion 16 is provided at about the center of a groove portion 14*a* formed in the baseplate 11, and the groove portion 14*a* is formed into such form that the upper end edge of a presser piece 25, which will be explained later on, can be fixed by keeping a slight space.

At the periphery of the communicating hole 12 opened to the side of the storing portion 16 is projected an annular rib 11*a* for reinforcement, while at the inner periphery of the communicating hole 12 is detachably fixed a coupling tube 13. The coupling tube 13 is composed of a first coupling tube 13*b* projected into the storing portion 16 and a second coupling tube 13*c* projected into the thread portion, and provided with a flow hole 13*a* passed through the center portion in a vertical direction (FIG. 3, FIG. 6).

The first coupling tube 13*b* is composed by tilting its open end in the direction far away from the hinge portion 70 of the openable lid 20. To the first coupling tube 13*b* is detachably fixed the base end portion of a mouthpiece tube 30. Further, to the second coupling tube 13*c* is detachably connected the base end portion of the suction tube 32 inserted into the bottom of the beverage container B. Moreover, at the end of the mouthpiece tube 30, if necessary, can be fixed a mouthpiece portion 31 tapered into the end portion.

In addition, the mouthpiece tube 30 and the suction tube 32, for example, are formed into tubes with elastic and flexible synthetic resin material such as polyurethane, silicon resin and the like (FIG. 6).

Figure 2:
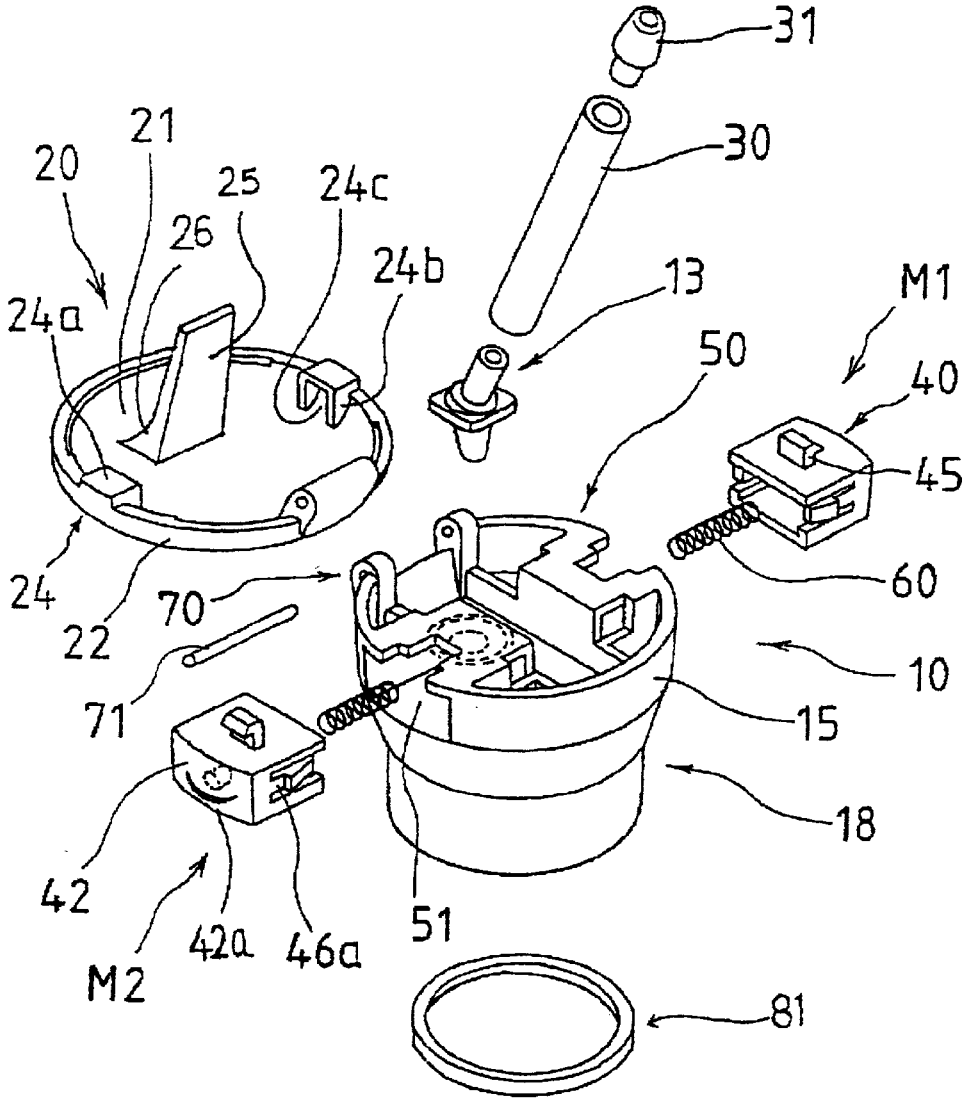
FIG. 2 is a perspective view exploding the lid body of the beverage container of the invention.
Figure 2:
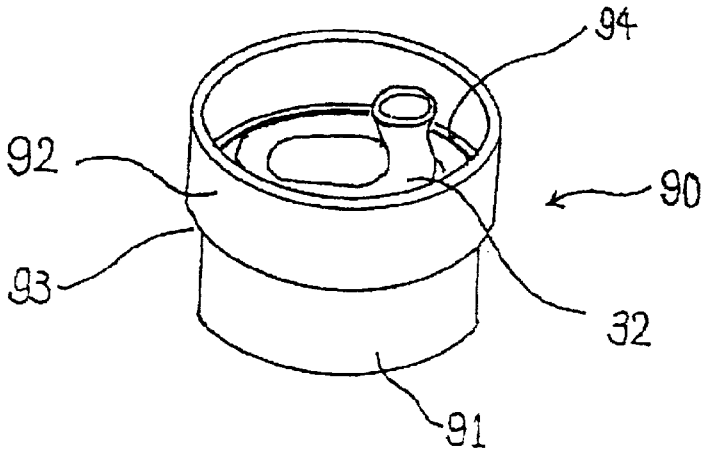
Figure 3:
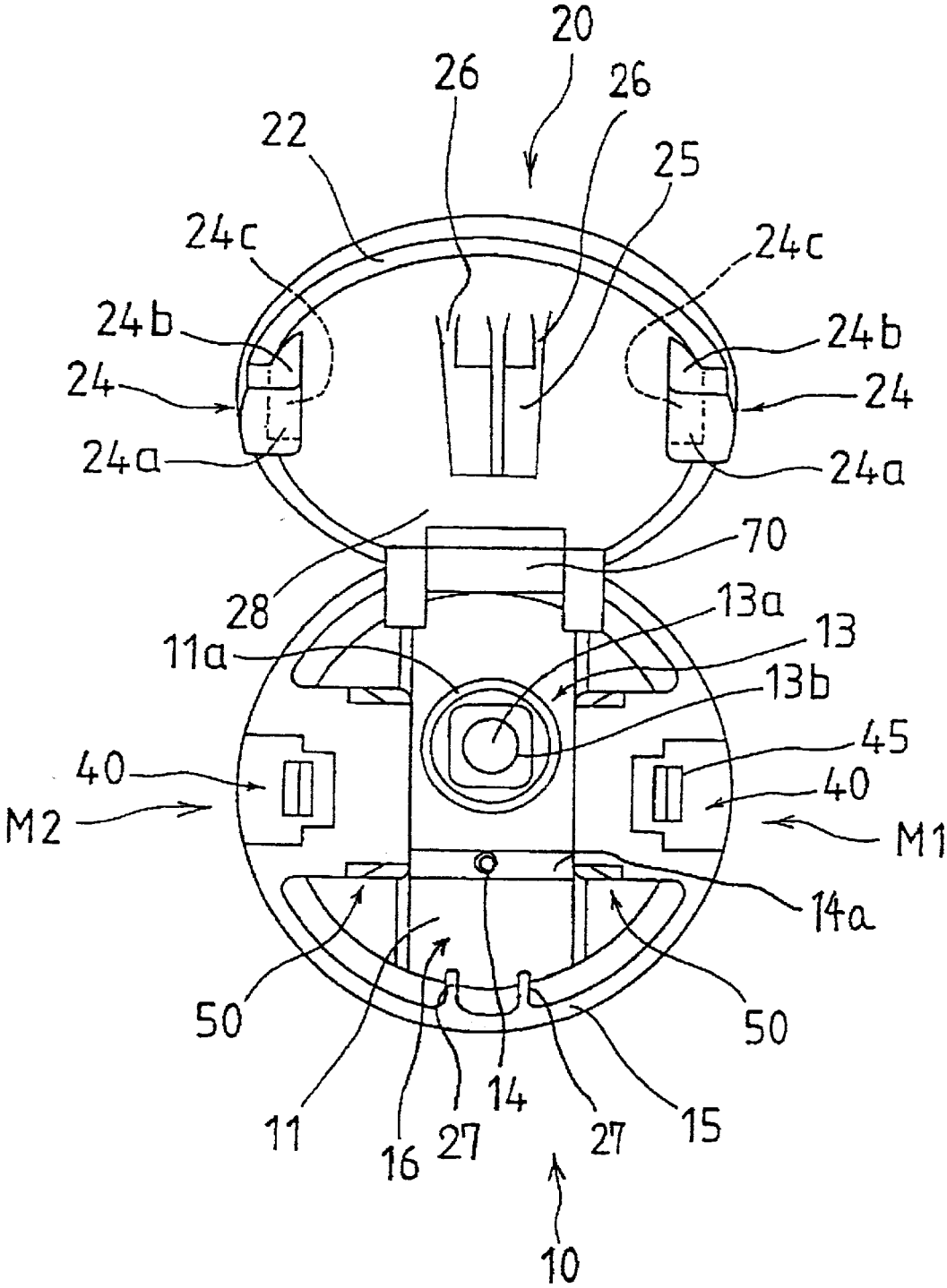
FIG. 3 is a plane view showing the opened lid body of the beverage container of the invention.

FIG. 2 is a perspective view showing an openable lid 20, a pair of switching devices M1, M2 and a coupling tube 13, a mouthpiece tube 30, a packing 81 and a cap 90 for storing a suction tube 32 removed from a main body portion 10, and FIG. 3 is a plane view showing the state of opening the openable lid 20 from the main body portion 10.

The pair of switching devices M1, M2 for controlling opening and closing of the openable lid 20 is provided at a notch portion of the peripheral wall portion 15 opposed to the radial direction of the storing portion 16. Further, each switching device M1, M2 is made of the same member arranged in opposition to each other, hence one switching device M1 will be explained in detail.

Figure 4:
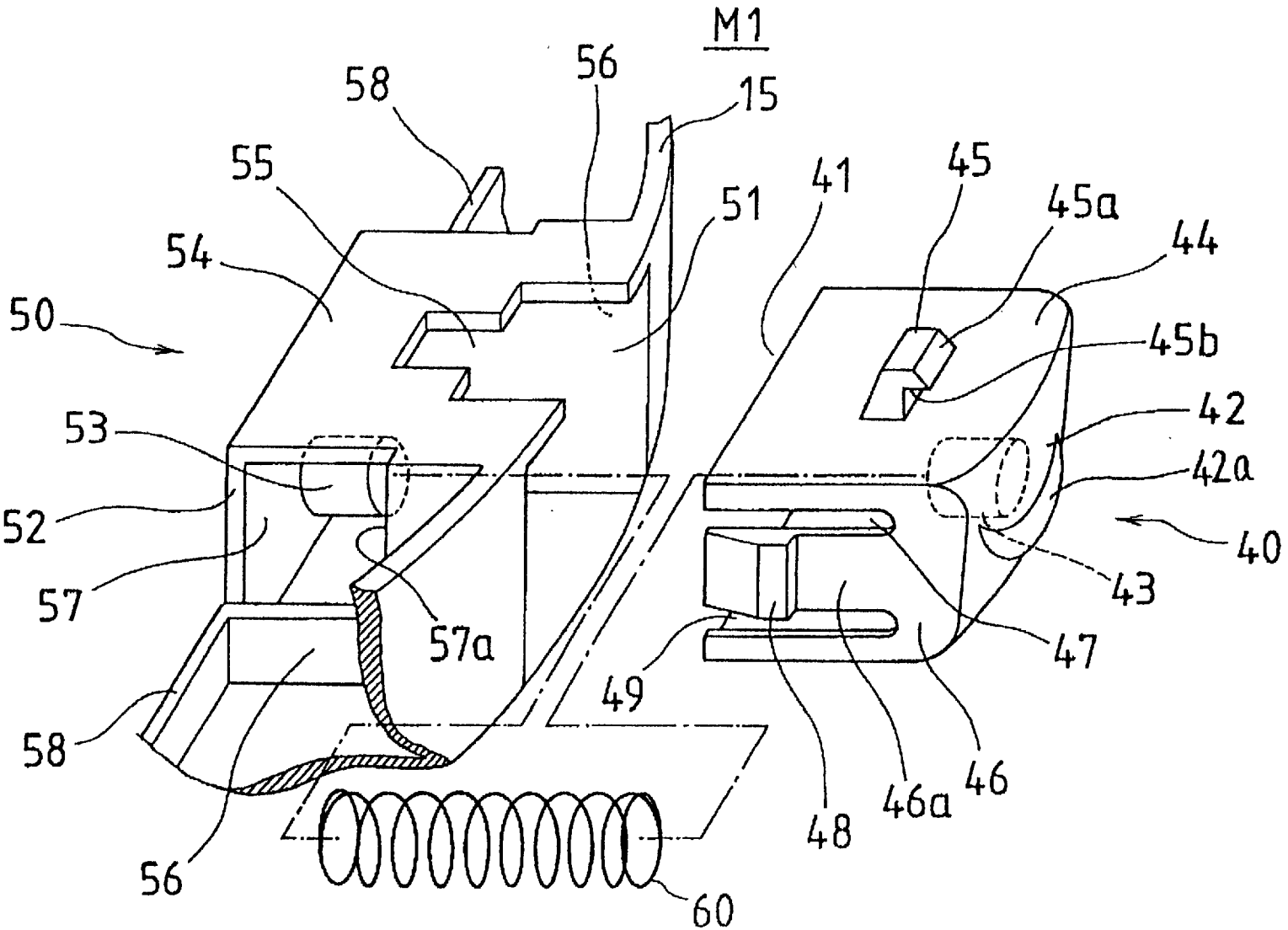
FIG. 4 is a schematically exploded view of one switching mechanism arranged on the lid body of the beverage container of the invention.

FIG. 4 is a perspective view showing the state of disassembling a socket 50 of the switching device M1 and a lock release button 40.

The switching device M1 is composed of a socket 50 and a lock release button 40 movably fixed within the socket. The socket 50 is an integrally molded member composed of a pair of side plates 56, 56 projected from both sides of the notch portion of a peripheral wall portion 15 to the inner side of a storing portion 16, a back plate 52 provided between the projected portions of each side plate 56, 56, and an upper plate 54 covering the surfaces of each side plate 56, 56. The side surface portion opposed to the back plate 52 is made an opening portion 51, and the lock release button 40 is movably fixed through the opening portion 51.

A convex type notch 55 is provided in the upper plate 54 from the opening portion 51 toward the back plate 52 direction. Further, corner portions of both the side plates 56, 56 made contact with the back plate 52 and the upper plate 54 are rectangularly notched, so as to form notched windows 57, 57 having edge portions 57*a*, 57*a* connected with stopper protrusions 48, 48 formed in the lock release button 40 which is described later on.

From both the side plates 56, 56 positioned downward the notched windows 57, 57 are stretched to the outside direction on the same face with the back plate 52 and projecting pieces 58, 58 connected to the inner peripheral wall 15 at the end portion are integrally projected and molded. Further, within the inner face of the back plate 52 is provided a protrusion 53 for inserting and fixing one end portion of a spring 60.

On the other hand, the lock release button 40 is almost a box type member integrally molded with an upper plate 44, a pair of side plates 46, 46, a baseplate 49 and a pressure wall 42, and a side face portion opposed to the pressure wall 42 is an opening portion 41.

From the upper plate 44 is projected a hook-like stopper piece 45 having an inclined face 45*a* attached to a connecting portion 24 of the openable lid 20, which will be described later on, and a lower edge portion 45*b* coupled with the connecting portion 24.

In both the side plates 46, 46 are bored a pair of upper and lower notched grooves 47, 47 from the opening portion 41 toward the pressure wall 42, and overhanging pieces 46*a*, 46*a* are formed between the notched grooves 47, 47. At the end portions of the notched grooves 47, 47 are formed stopper protrusions 48, 48 protruded each other outwardly, and the stopper protrusions 48, 48 are detachably connected to edge portions 57*a*, 57*a* of the notched windows 57, 57 provided in the socket 50.

An outer surface of the pressure wall 42 is curved to almost the same surface with the peripheral wall portion 15, and on the outer surface is formed a protrusion for identifying the position of the lock release button 40 with the inner surface of a finger or an identification portion 42*a* consisting of a protrusion. (In FIG. 4, a crescent-shaped projection is formed.) Further, the inner wall of the pressure wall 42 is provided with a protrusion 43 for inserting and fixing the other end portion of a spring 60.

Assembling of the lock release button 40 and the socket 50 is explained. The lock release button 40 is fitted within the opening portion 51 of the socket 50 under the condition of inserting one end portion of the spring 60 into the protrusion 43 of the lock release button 40 and the other end portion into the protrusion 53 of the socket 50. As ends of each overhanging piece 46*a*, 46*a* formed in both the side plates 46, 46 of the lock release button 40 are free ends, each overhanging piece 46*a*, 46*a* is slightly bent each other in the inner side direction and inserted into the socket 50, and each stopper protrusion 48, 48 formed in each overhanging piece 46*a*, 46*a* is inserted into each notched window 57, 57 through the back sides of both the side plates 56, 56.

The lock release button 40, by energization force of the spring 60, in FIG. 4, moves to the right direction, but each stopper protrusion 48, 48 is protruded from each notched window 57, 57, so that each stopper protrusion 48, 48 is connected to each edge portion 57*a*, 57*a* of the notched windows 57, 57, respectively, so as not to slip away from the socket 50.

Moreover, the stopper piece 45 is projected from the upper plate 44 of the lock release button 40, but a convex type notched inlet 55 is formed on the upper plate 54 of the socket 50, so as to have no influence on assemblying the lock release button 40. Further, the lock release button 40 can move until the stopper piece 45 is made into contact with the innermost portion (left inner part in FIG. 4) of the convex notched inlet 55 against energization force of the spring 60.

Next, the openable lid 20 will be explained.

The openable lid 20 is openably pivoted on the upper peripheral wall portion 15 of the main body portion 10 by a pivot pin 71 provided in the hinge portion 70, and has a top board 21 which cross section is slightly curved downward and a peripheral edge portion 22 formed in the periphery of the top board 21 (FIG. 2, FIG. 3).

A pair of connecting portions 24, 24 is provided on the peripheral portion 22 of the top board 21 corresponding to the pair of switching devices M1, M2. Each connecting portion 24, 24 is composed of receiving pieces 24*a*, 24*a* projected from the peripheral portion 22 to the radial direction, respectively, and a pair of ribs 24*b*, 24*b* for supporting the receiving pieces 24*a*, 24*a* from the back of the top board 21, and depressions 24*c*, 24*c* are formed between the top board 21 and the receiving pieces 24*a*, 24*a*.

Figure 5:
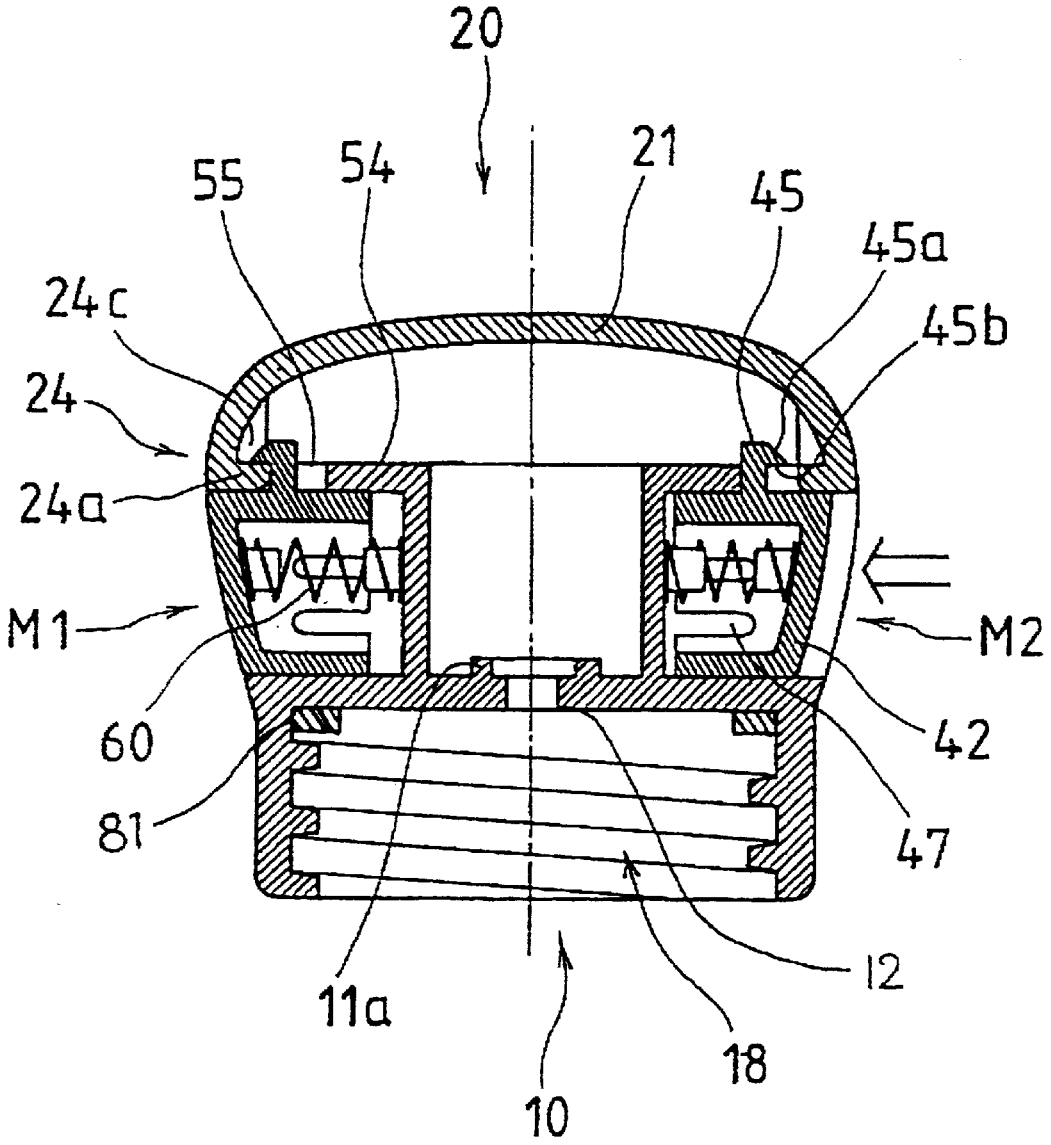
FIG. 5 is a schematically longitudinal section showing the connecting condition between the connecting portion and the switching mechanism of the lid body of the beverage container of the invention (left side is complete connection and right side is connection release).

FIG. 5 is a longitudinal section showing the state of closing the openable lid 20 in the main body portion 10, the left side of the same drawing shows the state of completely connecting the connecting portion 24 of the openable lid 20 to the switching device M1, and the right side of the same drawing shows the state of immediately after disconnecting the connecting portion 24 from the switching device M2, respectively.

As soon as the openable lid 20 is started to close, the end edges of each receiving piece 24*a*, 24*a* press hook-like inclined faces 45*a*, 45*a* of each stopper piece 45, 45 of each lock release button 40, 40 in the inside direction of the sockets 50, 50 against energization force of the springs 60, 60 with pressure.

Then, when the end edges of each receiving piece 24*a*, 24*a* are passed each inclined face 45*a*, 45*a*, each lock release button 40, 40 moves in the direction parting from respective sockets 50, 50 by energization force of the springs 60, 60, so that the lower edge portions 45*b*, 45*b* of each stopper piece 45, 45 are fitted and connected within depressions 24*c*, 24*c* of each connecting portion 24, 24 (left drawing of FIG. 5). Thereby, each connecting portion 24, 24 is completely connected with each lock release button 40, 40 to completely close the main body portion 10 by means of the openable lid 20.

In order to open the openable lid 20, each pressure wall 42, 42 is pressed with pressure against energization force of each spring 60, 60, and the lock release buttons 40, 40 are moved in the inside direction of the sockets 50, 50. (arrow direction of FIG. 5) Each stopper piece 45, 45 is moved in the same direction by this pressure, the lower edge portions 45*b*, 45*b* of each stopper piece 45, 45 are separated from depressions 24*c*, 24*c* of each connecting portion 24, 24. Thereby, each connecting portion 24, 24 is released from connection with each lock release button 40, 40.

On the back of the top board 21 is projected a presser piece 25 in parallel to the hinge portion 70. The presser piece 25 is composed of a flat plate body at the upper edge, while on the inner wall of the storing portion 16 opposed to the presser piece 25 are projected a pair of guide ribs 27, 27 for guiding a mouthpiece tube 30 folded by the presser piece 25.

Further, the base of the presser piece 25 is provided with a plurality of ribs 26 for projectingly supporting the presser piece 25 (FIG. 2, FIG. 3).

Around the outer periphery of the thread portion 18 of the main body portion 10 is fittingly arranged the cap 90 for storing the suction tube 32 within the inside. The cap 90, for example, is a cylindrical member opened at one end portion molded with plastic material having appropriate elasticity such as polypropylene, ABS resin and the like.

The cap 90 comprises a container portion 91 for storing the suction tube 32 detachably connected to the second coupling tube 13*c* at the base end portion and inserted into the bottom within the beverage container B at the end portion and a cylindrical standing wall 92 stood from the opening portion of the container portion 91 via the annular step portion 93 and fitted to the outer peripharal surface of the thread portion 18.

Figure 8:
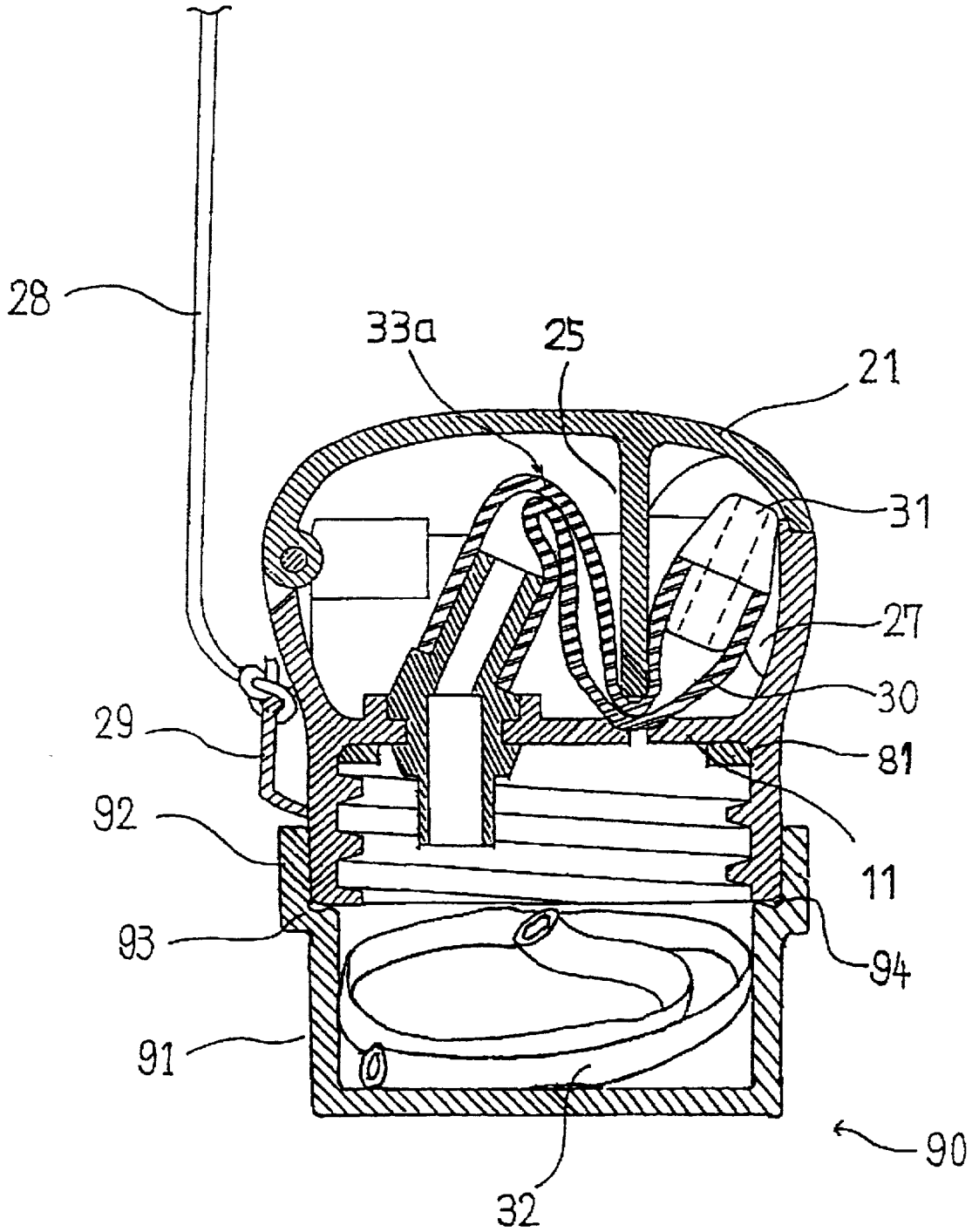
FIG. 8 is an expanded sectional view diagram showing the condition of securing the cap stored suction tube to the lid body of the beverage container of the invention and tying a suspension strap to the main body portion.

Further, in order to closely adhere and fit the inner surface of the standing wall 92 to the outer peripheral surface of the thread portion 18, the inner wall of the step portion 93 is formed with the annular groove 94 for deforming the standing wall 92 slightly in the radial direction (FIG. 2, FIG. 8).

Moreover, in order to easily carry the lid body of the beverage container without losing, the main body portion 10 is provided with a stopper piece 29 for tying a suspending strap 28, and the other end portion of the suspending strap 28 is formed with appropriately shaped hook and loop portions for suspension.

Next, an embodiment of using the lid body of the invention is explained.

First, under the condition of coupling the mouthpiece tube 30 with the first coupling tube 13*b*, the openable lid 20 is closed and the mouthpiece tube 30 is stored within the storing portion 16, while the annular packing 81 is inserted into the corner periphery of the baseplate on the side of the thread portion 18. Then, the cap 90 stored the suction tube 32 in the container portion 91 is fitted to the outer periphery of the thread portion 18. Under this condition, the lid body of the invention is prepared.

In addition, in order to make carrying the container easily, it is preferable to tie the suspending strap 28 to the stopper piece 29 (FIG. 8).

In case of use, the cap 90 is removed from the thread portion 18, the suction tube 32 is taken out of the container portion 91, and the base end portion is connected to the second coupling tube 13*c*. Then, the end portion of the suction tube 32 is inserted into the beverage container B, the female screw portion 17 formed in the inner wall of the skirt portion 19 of the lid body is fitted in the male screw portion B2 of the mouth portion B1 of the beverage container B, and the upper edge of the mouth portion B1 and the thread portion 18 are fitted and hermetically sealed via the annular packing 81.

In this condition, when the beverage container B is held by one hand, and the pressure walls 42, 42 of the lock release buttons 40, 40 are simultaneously depressed in the radial direction, the lock release buttons 40, 40 move in the inside direction of the sockets 50, 50 against energization force of the springs 60, 60 (arrow direction of FIG. 5).

As each of the above stopper pieces 45, 45 moves in the same direction at the same time, the lower edge portions 45*b*, 45*b* of each stopper piece 45, 45 are slipped away from the depressions 24*c*, 24*c*. Because the mouthpiece tube 30 is stored within the storing portion 16 under the forced and folded condition, when the lower edge portions 45*b* and 45*b* are separated from the depressions 24*c*, 24*c*, the mouthpiece tube 30 pushes the top board 21 by its elastic force, automatically opens the openable lid 20 with pressure and stands by outwardly projecting from the storing portion 16. Since the first coupling tube 13*b* is tilted in the direction apart from the hinge portion 70 at the open end, the end portion of the mouthpiece tube 30 is projected at the position far from the openable lid 20 (FIG. 6).

Moreover, when the mouthpiece portion 31 consisting of comparatively hard synthetic resin material is inserted in the end of the mouthpiece tube 30, the mouthpiece tube 30 is slightly bent by weight of the mouthpiece portion 31, so that the mouthpiece portion 31 can easily be taken in mouth, but even if there is no mouthpiece portion 31, sucking and drinking is not inconvenient.

Further, even if the beverage is sucked and the internal pressure of the beverage container B is lowered, the internal pressure of the beverage container B becomes equal to the external pressure to make drinking smooth because the air hole 14 is formed.

Figure 7:
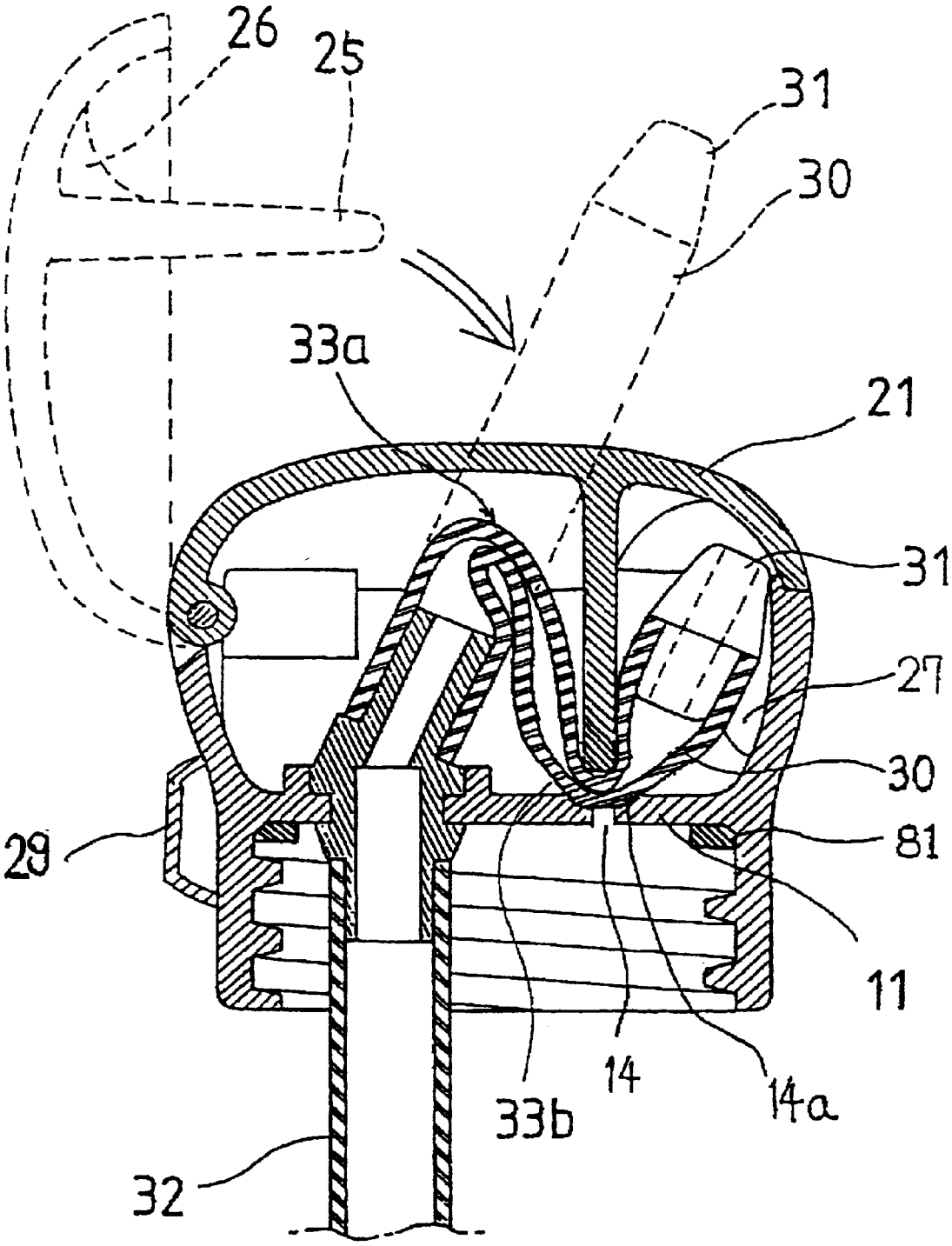
FIG. 7 is an expanded sectional view diagram showing the opened condition to the closed condition of the openable lid of the lid body of the invention (a chain line shows the state of the opened lid, and a full line shows the state of the closed lid).

Next, in case of non-use, that is, the case of closing the openable lid 20 by drinking the beverage up is explained. FIG. 7 shows a sectional view showing the opening condition to the closing condition of the openable lid 20.

First, when the beverage container B is held by one hand and the top board 21 of the openable lid 20 is pushed down by the thumb and the like, the top board 21 is rotated in the direction of the storing portion 16 by using the hinge portion 70 as a fulcrum, and the presser piece 25 of the back of the top board 21 pushes the mouthpiece tube 30 within the storing portion 16 by means of the upper end edge. In this case, as a pair of guide ribs 27, 27 is provided in the inner wall of the storing portion 16 opposed to the presser piece 25, the end portion of the mouthpiece tube 30 is held between the pair of guide ribs 27, 27, and guided to the direction of the baseplate 11 with the action of the presser piece 25.

On the other hand, the peripheral portion 22 of the top board 21 is guided by a plurality of standing edges 15*a* provided in the inner wall of the peripheral wall portion 15 of the storing portion 16 and begins to make contact with the upper edge of the peripheral wall portion 15. Further, when the top board 21 is pushed down, end edges of each receiving piece 24*a*, 24*a* of the connecting portions 24, 24 press hook-like inclined surfaces 45*a*, 45*a* of the stopper pieces 45, 45 of each lock release button 40, 40 in the inside direction of the sockets 50, 50 with pressure against energization force of the springs 60, 60.

Then, when the end edges of each receiving piece 24*a*, 24*a* pass the inclined surfaces 45*a*, 45*a*, each lock release button 40, 40 moves to the direction apart from the sockets 50, 50 by energization force of the springs 60, 60, so that the lower edge portions 45*b*, 45*b* of each stopper piece 45, 45 are fitted in and connected with depressions 24*c*, 24*c* of each connecting portion 24, 24. (left view of FIG. 4) Thereby, the openable lid 20 closes the main body portion 10.

As the mouthpiece tube 30, for example, is a tubular member made of elastic and flexible synthetic resin material such as polyurethane, silicon resin and the like, when it is pushed in the storing portion 16 by the presser piece 25, in the mouthpiece tube 30 is formed a first bending portion 33*a* bent just above the first coupling tube 13*b* at an acute angle in the directly below direction.

Further, the mouthpiece tube 30 is sandwiched between the upper edge of the presser piece 25 and the groove portion 14*a* formed in the baseplate 11 under the condition held between a pair of guide ribs 27, 27 of the storing portion 16 at the end portion, so that a second bending portion 33*b* is formed in the portion of this sandwiched mouthpiece tube 30 (FIG. 7).

Therefore, when the openable lid 20 is closed, the mouthpiece tube 30 is folded by the first bending portion 33*a* and the second bending portion 33*b* by means of the presser piece 25 and stored within the storing portion 16.

At the first bending portion 33*a* and the second bending portion 33*b*, the tube wall of the mouthpiece tube 30 positioned at the inside in the bending direction is bent in the tube wall direction positioned at the outside, and made into contact with the tube wall positioned at the outside in the bending direction, so that the mouthpiece tube 30 is under the closed condition at each bending portion 33*a*, 33*b*. Further, at the second bending portion 33*b*, the mouthpiece tube 30 is inserted within the groove portion 14*a* by the presser piece 25 so as to block the air hole 14 with the tube wall of the mouthpiece tube 30.

Thus, a beverage does not leak from the mouthpiece tube 30 and the air hole 14, and the beverage never leaks within the storing portion 16 even if the beverage container B is tilted (FIG. 7).

Further, since the mouthpiece tube 30 is stored within the storing portion 16 in the pushed and folded condition against its elasticity by the presser piece 25, upward force acts on the presser piece 25, thereby coupling receiving pieces 24*a*, 24*a* of each connecting portion 24, 24 with lower edge portions 45*a*, 45*a* of each stopper piece 45, 45 strongly.

Figure 9:
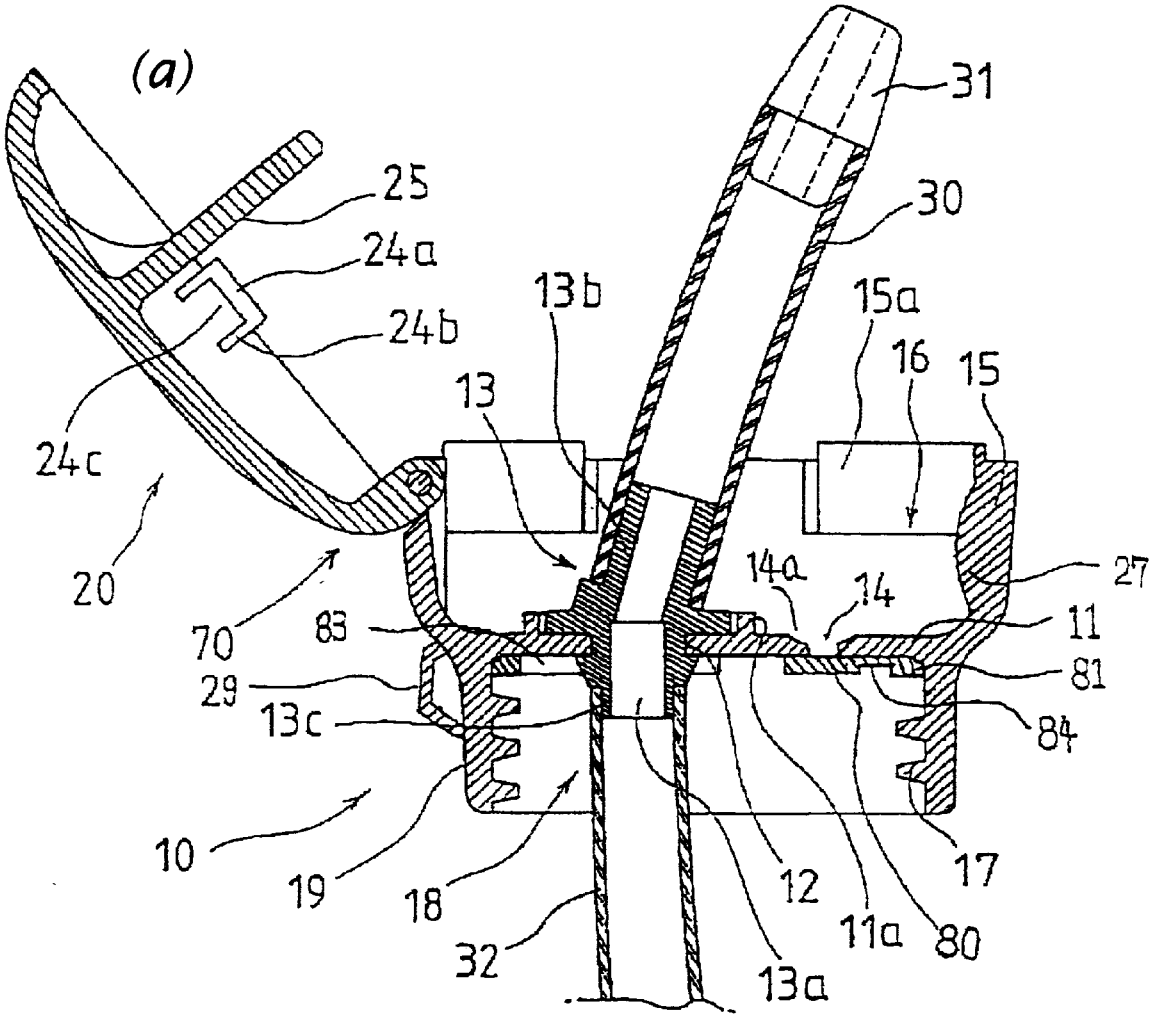
FIG. 9 is an expanded sectional view showing another embodiment of the annular packing mounted on the lid body of the beverage container of the invention (FIG. 9(*a*) is a phase diagram showing the annular packing mounted on the lid body, and FIG. 9(*b*) is a perspective view of the annular packing).
Figure 9:
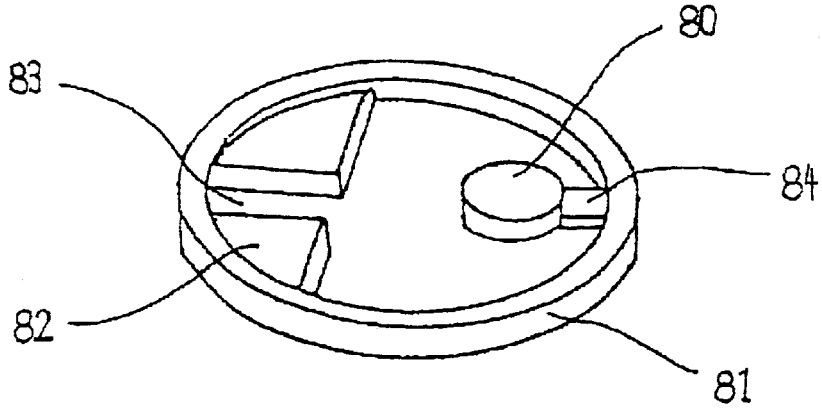
Figure 10:
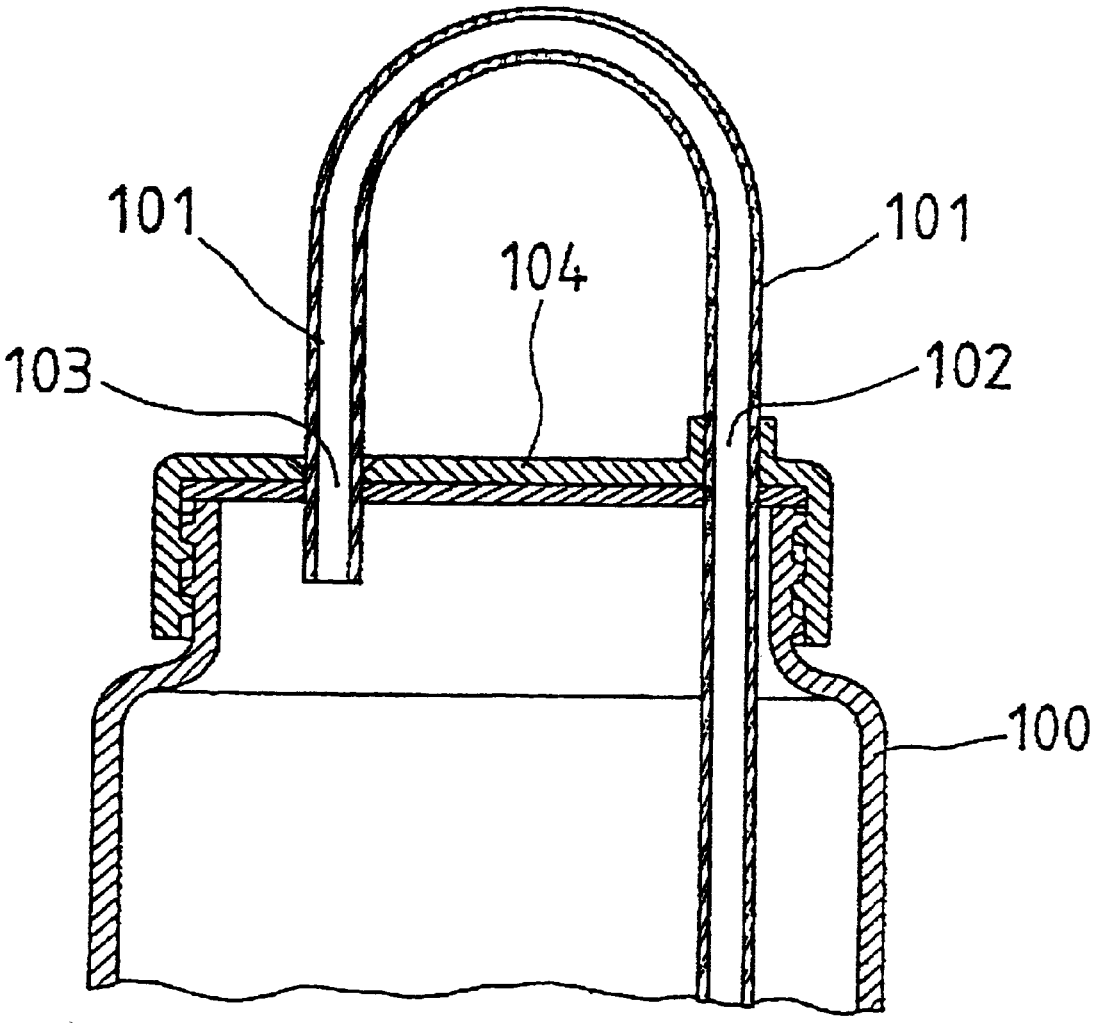
FIG. 10 is a fragmentary sectional view of the lid body of the beverage container for showing prior art.

Next, the other embodiment is explained. FIG. 9 is a schematic view showing the other embodiment of an annular packing 81 inserted into the lid body of the beverage container according to the invention. FIG. 9(*a*) shows a phase diagram of mounting the annular packing, and FIG. 9(*b*) shows a perspective view of the annular packing.

According to this embodiment, the annular packing 81 is coupled with a valve body 80 for blocking the air hole 14 opened to the side of the thread portion 18 via a thin movable portion 84. The movable portion 84 energizes the valve body 80 to the direction for blocking the air hole 14. In the inner periphery of the annular packing 81 is projected a lock piece 82 having an insertion portion 83 inserted in the second coupling tube 13*c* in the radial direction.

And, there is such a construction that when the annular packing 81 is inserted into the corner periphery of the baseplate 11 on the side of the thread portion 18 by inserting the second coupling tube 13*c* projected within the thread portion 18 into the insertion portion 83 of the lock piece 82, the valve body 80 blocks the air hole 14.

Therefore, in case of screwing the lid body in the mouth portion B1 of the beverage container B, the annular packing 81 is prevented from rotation by the second coupling tube 13*c* inserted in the insertion portion 83, so that the valve body 80 is not disconnected from the air hole.14.

Further, when a beverage is sucked from the end portion of the mouthpiece tube 30, it is difficult to continue drinking by lowering the internal pressure of the beverage container B, but the valve body 80 starts to act by the external pressure and the air hole opens, and the internal pressure and the external pressure of the beverage container B become equal to give smooth sucking and drinking.

Moreover, the annular packing 81, the valve body 80, the movable portion 84 and the lock piece 82 are integrally molded with plastic material having appropriate elasticity such as polypropylene, ABS resin and the like.

As mentioned above, according to the invention, a mouthpiece tube 30 can completely be blocked, because the mouthpiece tube 30 stood from a storing portion 16 is folded in the horizontal condition across the mouthpiece tube 30 in the transverse direction at the flat upper edge of a presser piece 25 with closing action of an openable lid 20 and stored in the storing portion. Therefore, during the lid closing, even if a beverage container B falls or is vigorously shaken, there is no possibility of leaking a beverage from the mouthpiece tube 30.

Further, as the mouthpiece tube 30 is raised by its elasticity with opening action of the openable lid 20, there is no need to push open the openable lid 20 by hands, and there is no need to pull out and raise the mouthpiece tube 30 from the storing portion by hands.

Therefore, even in the midst of the condition where both hands cannot be used, for example, sports, cycling, drive and the like, and even a patient, who has a trouble in one hand or cannot freely use both hands, can open the openable lid 20 by one-touch handling with one hand and sucks and drinks a beverage from the mouthpiece tube 30, and further closes the openable lid 20 by one-touch handling and stores the mouthpiece tube 30 without leaking the beverage outside.

According to the invention, in order to open the openable lid 20, it is necessary to operate each switching device M1, M2 simultaneously. Therefore, in the condition of the closed openable lid, if a beverage container B falls, or rolls, or is vigorously shaken vertically, each of the switching devices M1, M2 is not functioned at the same time, and there is no possibility of jumping the mouthpiece tube 30 out of the storing portion 16 by opening the openable lid 20 and leaking a beverage outside.

Further, as the switching devices M1, M2 are provided in the peripheral wall portion 15 opposed to the radial direction of the storing portion 16, each of the switching device M1, M2 can simultaneously be handled with the thumb and the first finger in the condition of gripping the thread portion 18 of the lid body by one hand, and as the top board 21 can be pushed down with the inner surface of the thumb, opening and closing operation of the openable lid can simply be carried out.

Further, when the openable lid 20 is closed, the air hole 14 is blocked with the tube wall of the mouthpiece tube 30 folded by the presser piece 25, and there is no possibility of leaking a beverage from the air hole 14 at the time of non-use. Further, the air hole 14 can securely be closed by interlocking with an action of closing the lid.

According to the invention, as the tube wall of the mouthpiece tube 30 horizontally folded at the upper edge of the presser piece 25 is fitted in the groove portion 14a of the baseplate 11, closing of the mouthpiece tube 30 and that of the air hole 14 by the tube wall of the mouthpiece tube 30 can securely be carried out.

According to the invention, as the end portion of the mouthpiece tube 30 is held between a pair of guide ribs 27, 27 with the action of the presser piece 25 and guided to the direction of the base plate with the action of the presser piece 25, the mouthpiece tube can securely be pushed and folded.

According to the invention, as an identification portion 42*a* for identifying the position with the inner surface of a finger is provided on the outer surface of the pressure wall 42 for pressing lock release buttons 40, 40 with pressure, even any visually handicapped person and blind person, or at a situation where nobody can look away such as drive, cycling and the like, it is possible to confirm the existing position of the lock release buttons 40, 40 with the tip of a finger.

According to the invention, as there is provided a valve body 80 for opening and closing the air hole 14, even when weak persons such as children, old people and others cannot completely close the openable lid, and as a result, the air hole 14 cannot sufficiently be blocked with the tube wall of the mouthpiece tube 30, the air hole 14 is blocked with the valve body 80, there is no possibility of leaking a beverage from the air hole 14 at the time of non-use. Further, at the time of use, when the beverage container is pressed by hand with pressure, a beverage within the inside can be pressed out of the mouthpiece tube 30, and a sucking and drinking amount can be controlled with hand.

According to the invention, as a valve body 80 is coupled via an annular packing 81 and a movable portion 84 inserted into the thread portion 18, the valve body 80 can be arranged with insertion of the packing 81, and hence the construction is simple.

According to the invention, as there is provided a lock piece 82 having an insertion portion 83 for inserting the second coupling tube 13*c* therein at the inner periphery of the annular packing 81, when the lid body is screwed in the male screw portion B2 of the mouth portion B1 of the beverage container B, the annular packing 81 can be prevented from rotation. Therefore, the valve body 80 never disconnected from the air hole 14.

According to the invention, as there is provided a hooking portion 29 for tying a suspending strap-like body 28 to the main body portion, the lid body can easily be carried out and missing thereof is lessened.

Further, at the time of using the lid body, when a person hangs from his neck a beverage container mounted the lid body thereon, even in the midst of cycling, drive and the like, it is possible to easily draw the beverage container near him.

According to the invention, as a cap 90 for storing the suction tube 32 is engageably provided in a lid body, when the cap is connected with the lid body, the lid body and the suction tube 32 are integrally controlled, and there is no possibility of losing the suction tube 32. Further, it is sanitary because the suction tube 32 and the thread portion 18 of the lid body can be prevented from adhesion of dust and foreign matter.

According to the invention, as a container portion 91 for storing a suction tube 32 is provided in the cap 90, even if the suction tube 32 is, for example, gyrationally stored in the container portion 91, the suction tube can adhere to the inner wall of the container portion 91 with its elasticity, and in case of removing the cap 90 from the thread portion, the suction tube 32 never jumps out of the cap 90.

According to the invention, as the cap 90 is fitted and connected with the outer peripheral surface of the thread portion 18 of the lid body, even a patient who cannot freely use his two hands can remove the cap 90 by one-touch action with one hand. Further, as a standing wall 92 is provided, the cap 90 cannot easily be separated from the thread portion 18.

What is claimed is:

1. A lid body, configured to be detachably mountable on a beverage container, the lid body comprising:

a main body portion comprising a baseplate;

an openable lid hingedly attached to the main body portion;

a raisable mouthpiece tube in the main body portion, the raisable mouthpiece tube flexibly extending into the beverage container through the baseplate when the lid body is mounted on the beverage container;

a presser piece having a flat upper edge, the presser piece being positioned on an inner surface of the openable lid, such that the presser piece is stored within the main body and is configured to block the mouthpiece tube in concert with a lid-closing motion of the openable lid and to cause the mouthpiece tube to block an airhole extending through the baseplate;

a plurality of switching devices positioned in opposition to each other along a radial direction of the main body portion; and a plurality of connecting portions, each of the plurality of connecting portions corresponding to and connecting with one of the plurality of switching devices, the plurality of connecting portions being positioned on the inner surface of the openable lid.

2. A lid body, configured to be detachably mountable on a beverage container, the lid body comprising:

a main body portion comprising a storing portion for storing a mouthpiece tube; a thread portion, configured to threadably connect the lid body to a mouth portion periphery of the beverage container, to which the lid body is mountable; and a common baseplate separating the storing portion and the thread portion, the common baseplate defining an air hole and a communicating hole for communicating the storing portion and the thread portion;

an openable lid hingedly mounted on the main body portion;

a coupling tube fitted in the communicating hole for detachably connecting the mouthpiece tube to a suction tube, the suction tube being extendable into the beverage container when the lid body is mounted on the beverage container;

a pair of switching devices positioned in opposition to each other along a radial direction of the storing portion;

a pair of connecting portions for connecting with the corresponding pair of switching devices, the pair of connecting portions being positioned on an underside of the openable lid; and a presser piece having a flat upper edge, the presser piece being positioned on the underside of the openable lid such that the presser piece is stored within the main body portion so as to block the mouthpiece tube, causing the mouthpiece tube to fold when the openable lid is in a closed position, and thereby causing the air hole to be blocked by a tube wall of the folded mouthpiece tube.

3. The lid body according to claim 2, the baseplate comprising a groove portion configured to fit the tube wall of the folded mouthpiece tube.

4. The lid body according to claim 2, the storing portion comprising a pair of projecting ribs configured to guide the mouthpiece tube to an inner wall.

5. The lid body according to claim 2, each of the pair of switching devices comprising a socket integrally formed with the storing portion and a lock release button flexibly movable within the socket, the lock release button comprising a stopper piece, connectable with the corresponding connecting portion, and an identification portion for identifying a position of the lock release button by contact with a finger of a user.

6. The lid body according to claim 2, the air hole open to the thread portion comprising a valve body for opening and closing the air hole.

7. The lid body according to claim 6, the valve body being coupled to an annular packing of the thread portion via a movable portion.

8. The lid body according to claim 7, the annular packing comprising a peripheral clamp piece on an inner periphery of the annular packing, the peripheral clamp piece having an insert portion of the coupling tube.

9. The lid body according to claim 1, the main body portion further comprising a hook portion configured for tying a strap-like body to the lid body to enable suspension of the beverage container.

10. The lid body according to claim 2, the main body portion further comprising a hook portion configured for tying a strap-like body to the lid body to enable suspension of the beverage container when the lid body is mounted on the beverage container.

11. The lid body according to claim 1, further comprising:

a cap connectable with the main body portion; and a suction tube connectable with the mouthpiece tube and extendable into the beverage container when the lid body is mounted on the beverage container, wherein the suction tube is stored in the cap.

12. The lid body according to claim 2, further comprising:

a cap connectable with the main body portion, wherein the suction tube is stored in the cap.

13. The lid body according to claim 11, the cap comprising a container portion for storing the suction tube, a step portion connected with the container portion and a circumferential wall projecting upwardly from the step portion.

14. The lid body according to claim 12, the cap comprising a container portion for storing the suction tube, a step portion connected with the container portion and a circumferential wall projecting upwardly from the step portion.

15. The lid body according to claim 13, the circumferential wall comprising an inner peripheral surface configured to fit around an outer peripheral surface of a thread portion of the lid body, the thread portion being configured to threadably connect the lid portion to the beverage container.

16. The lid body according to claim 14, the circumferential wall comprising an inner peripheral surface configured to fit around an outer peripheral surface of the thread portion of the lid body.

* * * * *